United States Patent [19]

Johenning

[11] Patent Number: 5,062,170

[45] Date of Patent: Nov. 5, 1991

[54] WATERBED MATTRESS AND CORNER STRUCTURE WITH TETHERED INSERT

[75] Inventor: John B. Johenning, Beverly Hills, Calif.

[73] Assignee: Strata Flotation, Inc., Torrance, Calif.

[21] Appl. No.: 569,096

[22] Filed: Aug. 17, 1990

Related U.S. Application Data

[63] Continuation-in-part of Ser. No. 490,130, Mar. 6, 1990, abandoned.

[51] Int. Cl.[5] ..... A47C 27/08

[52] U.S. Cl. ..... 5/450; 5/451; 29/428

[58] Field of Search ..... 5/451, 450, 452, 457, 5/458, 441, 474, 460, 449; 29/428

[56] References Cited

U.S. PATENT DOCUMENTS 948,644 2/1910 Bjornstad ..... 5/458

4,328,599 5/1982 Mollura ..... 5/451

4,345,348 8/1982 Hall ..... 5/450

FOREIGN PATENT DOCUMENTS 0059123 1/1982 European Pat. Off. ..... 5/451

*Primary Examiner*—Alexander Grosz

*Attorney, Agent, or Firm*—Flehr, Hohbach, Test, Albritton & Herbert

[57] ABSTRACT

Waterbed mattress and corner structure in which the mattress has walls of film material defining a chamber for holding water, with a cornerpiece substantially thicker and tougher than the film material joined to the film material and forming a corner of the mattress. An insert is disposed in the chamber for reducing wave action in the water and is retained in position by a tether. In some disclosed embodiments, the tether is connected to the cornerpiece, and in other disclosed embodiments, it is connected to other portions of the mattress walls.

23 Claims, 5 Drawing Sheets

WATERBED MATTRESS AND CORNER STRUCTURE WITH TETHERED INSERT

This is a continuation-in-part of U.S, Pat. Ser. No. 490,130, filed Mar. 6, 1990 , now abandoned.

The subject matter of this application/patent is also related to the subject matter of Ser. No. 395,715, filed Aug. 18, 1989 , now U.S. Pat. No. 4,930,172 the disclosure of which is incorporated herein by reference.

This invention pertains generally to waterbeds and, more particularly, to a waterbed mattress having an insert for reducing wave motion in the water within the mattress.

Heretofore, a number of different internal structures or inserts have been employed in waterbed mattresses in an effort to eliminate, or at least reduce, the wave motion which some people find disturbing. Some early efforts involved the use of vertically extending baffles which were connected to the upper wall of the mattress and produced an undesirable pulling or tensioning of the sleeping surface. In other mattresses, horizontally extending baffles are connected to the bottom and/or side walls, but not to the top walls. The connections between the baffle structure and the walls of a mattress are generally made by heat sealing or welding, and such connections can fail and result in leakage.

Some waterbed mattresses have been provided with baffle structures or masses of fiber which float freely within the mattresses and are not attached to the mattress walls. Such mattresses overcome the problems which arise when the insert is attached to the bladder or bag, but they are subject to other problems. The loose insert can slide around inside the mattress, and once out of position, it can be difficult to restore to the proper position.

The problem frequently arises when a mattress which has been filled with water must be moved. In order to move the mattress, it is generally necessary to drain the water from it. Typically, however, not all of the water drains out, and when one side or end of the partially drained mattress is raised, e.g., to roll or fold the mattress, the baffles or fibers slide toward the opposite side or end. This problem is particularly troublesome with fibers because they tend to form into a wet mass or ball which is difficult to smooth out when the mattress is refilled.

Another problem with waterbed mattresses of the prior art is vulnerablilty to puncturing by sharp objects such as metal fasteners which hold the frame of the bed together at the corners.

It is in general an object of the invention to provide a new and improved waterbed mattress and corner structure which overcome the limitations and disadvantages of mattresses heretofore provided.

Another object of the invention is to provide a waterbed mattress and corner structure of the above character in which an insert is retained in position within the mattress without stressing the top, bottom or side walls of the bladder or bag.

These and other objects are achieved in accordance with some disclosed embodiments by providing a waterbed mattress having walls of film material defining a chamber for holding water, a cornerpiece which is substantially thicker and tougher than the film material joined to the film material and forming a corner of the mattress, an insert disposed in the chamber for reducing wave action in the water, and a tether connected between the insert and the cornerpiece to retain the insert in a predetermined position in the chamber. In other embodiments, the tether is connected between the insert and other portions of the mattress walls.

Figure 11:
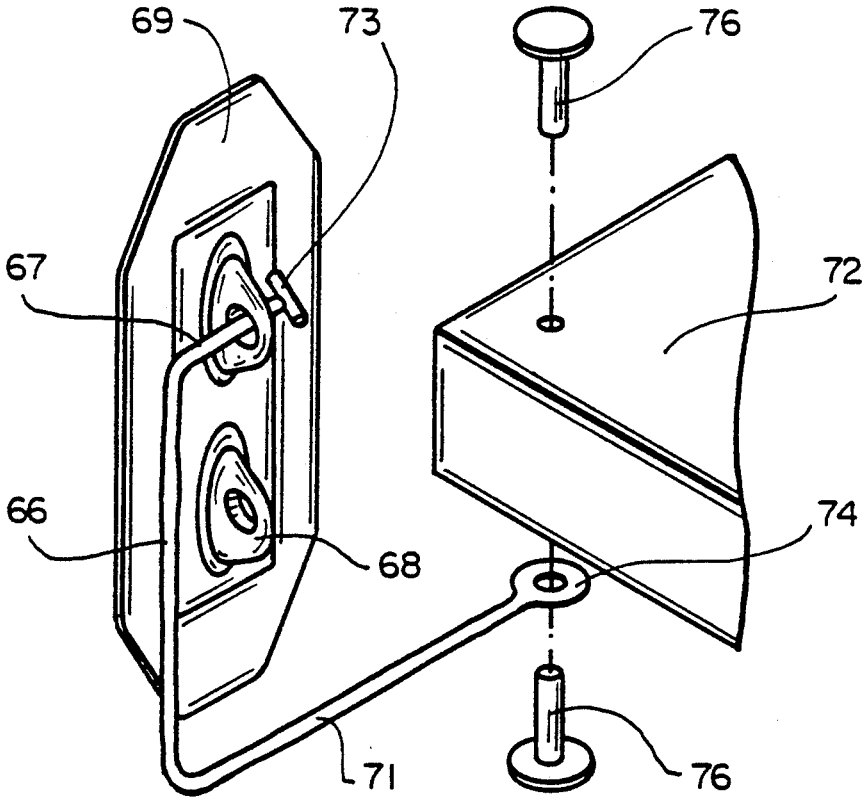

FIG. 11 an exploded isometric view of another embodiment of a waterbed mattress incorporating the invention.

Figure 1:
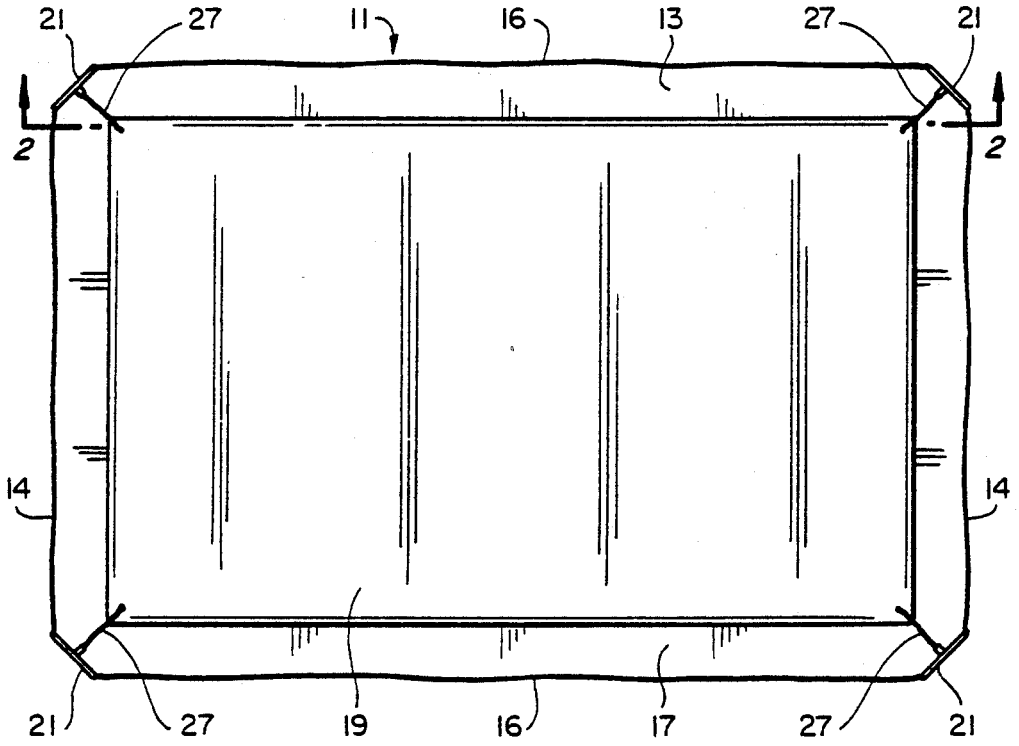
FIG. 1 is a horizontal sectional view of one embodiment of a waterbed mattress incorporating the invention.
Figure 2:
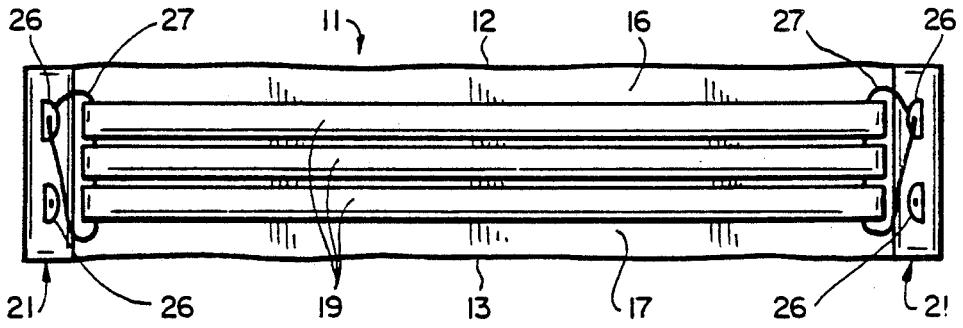
FIG. 2 is a cross-sectional view taken along line 2—2 in FIG. 1.

In FIGS. 1–2, the invention is illustrated in conjunction with a waterbed mattress 11 having generally rectangular top and bottom walls 12, 13, end walls 14 and side walls 16 which define a chamber 17 for holding a body of water (not shown). The walls are fabricated of a flexible, substantially inelastic material such water impervious plastic film, e.g. 20 mil polyvinylchloride.

An insert 19 is disposed in chamber 17 to reduce the wavelike motion of the water in the mattress. This insert can be of any suitable design, e.g. baffles or a fiber matt, which is not attached to the walls of the chamber. One suitable baffle structure is shown, for example, in Ser. No. 395,714, filed Aug. 18,1989.

Cornerpieces 21 are sealed to the top, bottom, end and side walls to form the four corners of the mattress. These cornerpieces are generally similar to the cornerpiece disclosed in Ser. No. 395,715, filed Aug. 18, 1989 , now U.S. Pat. No. 4,930,172, and have a base plate 22 with relatively heavy ridges in the form of cleats 23, beads 24 and raised lettering (not shown) projecting from the front side thereof.

The cleats, beads and raised lettering provide protection against punctures, as well as resistance to abrasion, and they also engage the bedsheets which are wrapped or tucked around the corners and thus help to retain the sheets in place on the mattress.

Means is provided for holding the insert 19 in a predetermined position in chamber 17. This means comprises eyelets 26 which project from the rear side of base plate 22 and tether straps 27 which extend between the cornerpieces and the corners of insert 19. Each of the eyelets includes a ring 28 with an opening 29 through which the strap passes, with the eyelets thus forming anchor points for the straps.

Figure 3:
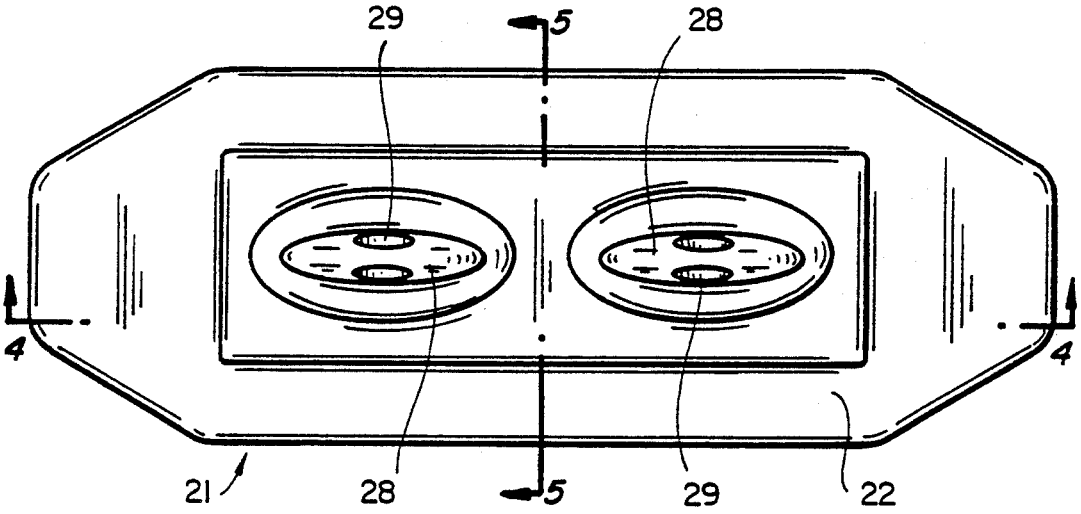
FIG. 3 is a rear elevational view of one embodiment of a corner structure for a waterbed mattress according to the invention.
Figure 4:
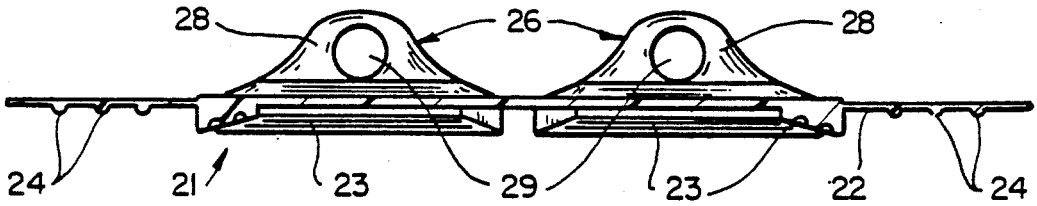
FIG. 4 is a cross-sectional view taken along line 4—4 in FIG. 3.
Figure 5:
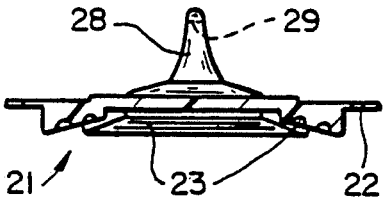
FIG. 5 is a cross-sectional view taken along line 5—5 in FIG. 3.

In the embodiment of FIGS. 3-5, each cornerpiece has two eyelets which are spaced vertically apart, with the rings 28 which form the eyelets lying in a common vertical plane and the openings 29 extending horizontally. Depending upon the type of insert, the tether strap can be attached to either the upper eyelet or the lower eyelet, or both. With a more buoyant insert, for example, the strap can be affixed to the lower eyelet to help hold the insert down, whereas a less buoyant insert might be tethered to the upper eyelet to help keep it afloat.

The base plate, eyelet rings, cleats, beads and raised lettering are all formed as a monolithic structure by a suitable process such as injection molding. This process provides a rugged solid structure and is preferred to other processes such as vacuum forming or pressure forming which would produce an embossed effect with indentations in the rear surface behind the raised lettering and other protuberances on the front side of the base plate. The cornerpiece is preferably fabricated of a material which can be affixed to the walls of the mattress by heat sealing, is pliant enough to conform to the contour of the mattress and is tough enough to resist puncturing. The cornerpiece is generally fabricated of the same type of material as the rest of the mattress, and in a vinyl mattress, for example, the cornerpiece is fabricated of vinyl.

The cornerpiece has a heavy construction which provides good protection against puncturing, maintains the integrity of the eyelets, and also provides a good grip on the bedsheets, as well as being aesthetically pleasing. In one presently preferred embodiment,.the corner piece has a length on the order of 8½ inches, a width on the order of 3¾ inches and a thickness on the order of 0.050 inch, with cleats 23 projecting about 0.110 inch along their outer edges, beads 24 projecting about 0.050 inch, and the raised lettering (not shown) projecting about 0.040 inch from the surface of the base plate. In this particular embodiment, the eyelet openings have a diameter on the order of 0.50 inch, and the rings which form the op have a thickness on the order of 0.375 inch at the base and 0.15 inch near the outer end. While 0.050 inch currently a preferred thickness for the base plate, base plate can have a thickness on the order of 0.020 to 0.080 inch for a mattress having a walls of 20 vinyl, and the other dimensions of the cornerpiece vary accordingly.

Figure 6:
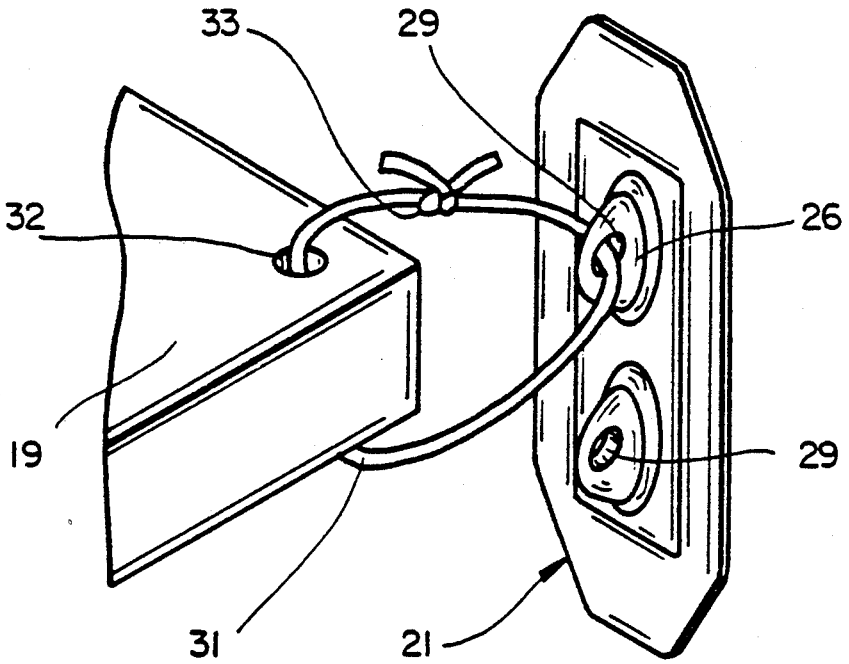
FIGS. 6–8 are fragmentary isometric views of additional embodiments of waterbed mattresses incorporating the invention.
Figure 7:
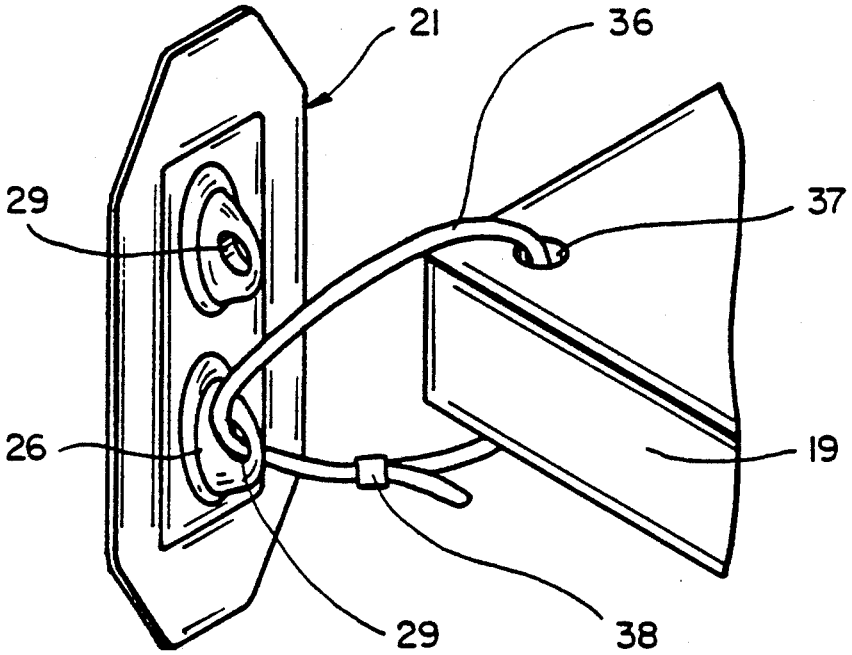
Figure 8:
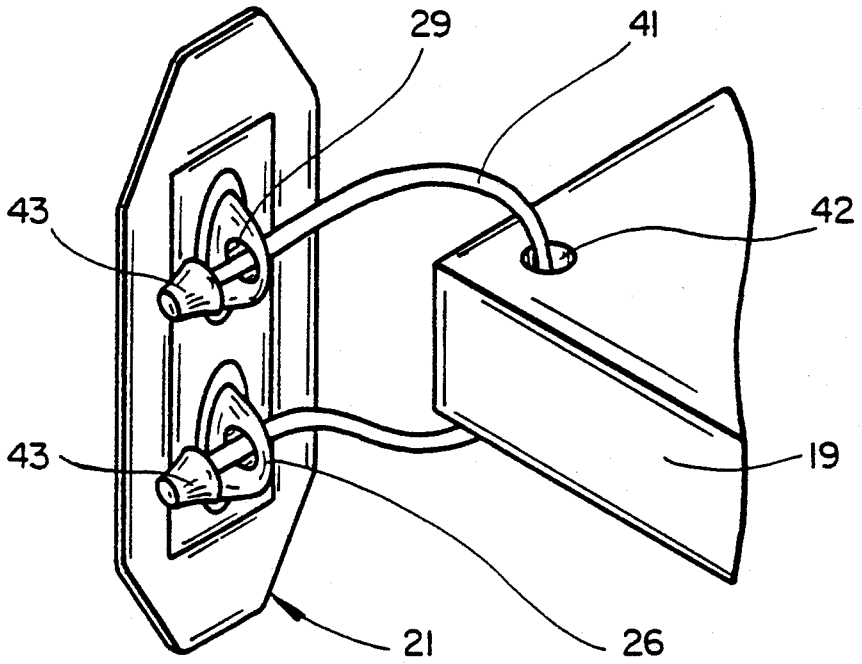

The tether straps 27 can be of suitable type, and three examples of suitable are illustrated in FIGS. 6–8.

In the embodiment of FIG. 6 of the tether straps comprises an elongated strap suitable material, such as vinyl, which is looped through an opening 32 in insert 19 and through the eyelet opening 29 in one of the cornerpieces, with the portions of the strap being knotted together as indicated at 33.

In the embodiment of FIG. 7, each of the tether straps comprises a plastic tie strip 36 of the type employed for bundling electrical wires and other items together. The tie strip is looped through an opening 37 in the insert and through the lower eyelet opening 29 in one of the cornerpieces, with the end portions of the strip being secured together by a fastener 38 which is formed as an integral part of the strip.

In the embodiment of FIG. 8, the tether strap comprises a strap 41 of suitable material such as vinyl which passes through an opening 42 in the insert and through the two openings 29 in one of the cornerpieces. Retainers 43 are attached to the two ends of the strap and are adapted to pass through the eyelets relatively freely in a forward direction but not in a reverse direction. In the embodiment illustrated, each of the retainers has a truncated conical shape with a tip diameter smaller than the eyelet openings and a base diameter larger than the eyelet openings, with either the retainer or the eyelet being deformable to permit the retainer to pass through the opening in the forward direction but not in the reverse direction. Thus, once inserted into the eyelets, the end portions of the strap are retained there by the retainers.

In addition to keeping the wave reducing insert in position when the mattress is being drained and/or moved, the tether straps can also function as a part of the wave reducing structure. With a relatively thin layer of fibers, for example, the straps can be made short enough to maintain the fibers in tension and keep them afloat during normal use of the mattress. In applications where the straps do not need to support the insert structure, they can be long enough to be relaxed in normal use, coming into tension only when the insert structure starts to shift.

Figure 9:
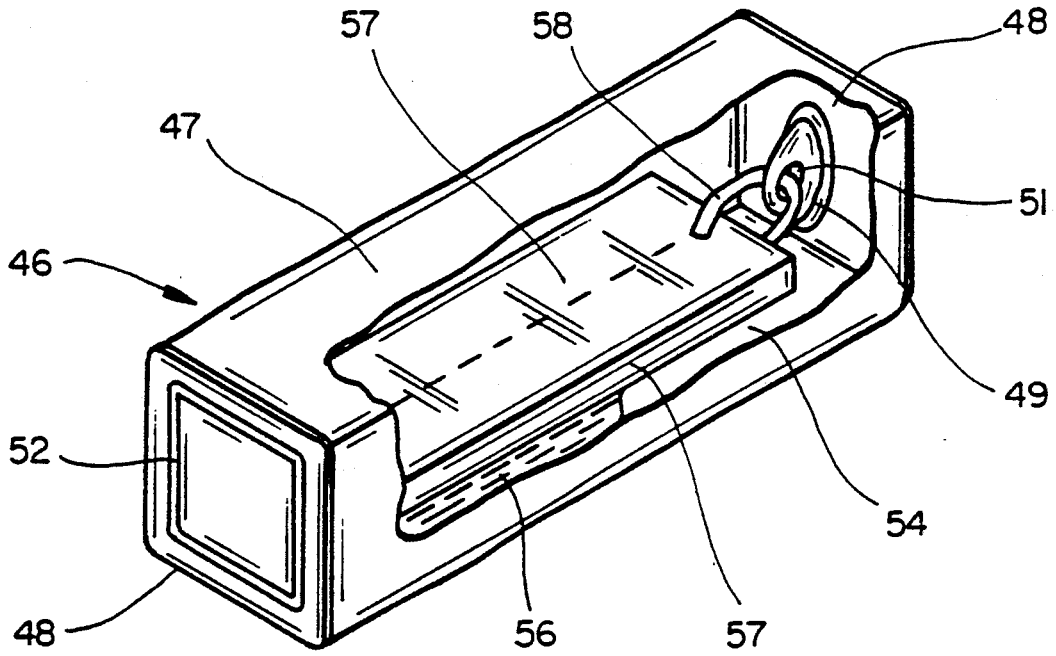
FIG. 9 is an isometric view, partly broken away, of a portion of another embodiment of a waterbed incorporating the invention.

FIG. 9 illustrates the invention in connection with an elongated tubular bladder 46 for use in a waterbed having a plurality of such tubular bladders positioned side-by-side to form a water mattress. This bladder has a tubular side wall 47 and a pair of end panels 48. The side wall is fabricated of a flexible, substantially inelastic material such as plastic film, e.g., 20 mil polyvinylchloride, and the end panels are fabricated of a material which can be sealed to the side wall.

Like the cornerpieces of the previous embodiments, the end panels have inwardly projecting eyelets 49 with openings 51 for receiving tether straps, and external ribs or beads 52 which help to hold the bedsheets in place. The end panels are formed as a monolithic structure by a suitable process such as injection molding, and they are preferably fabricated of a material which can be affixed to the side wall of the bladder by heat sealing and is tough enough to resist puncturing. With a vinyl side wall, for example, the end panels can be fabricated of polyvinylchloride.

The side wall and end panels form a chamber 54 which holds a body of water 56. To reduce wave action in the water, a horizontally extending fiber insert 57 is placed in the chamber and retained in position by tether straps 58 which pass through the openings 51 in eyelets 49. The length of the straps, and hence the tension in them, is adjusted in accordance with the degree of support desired for the insert.

Figure 10:
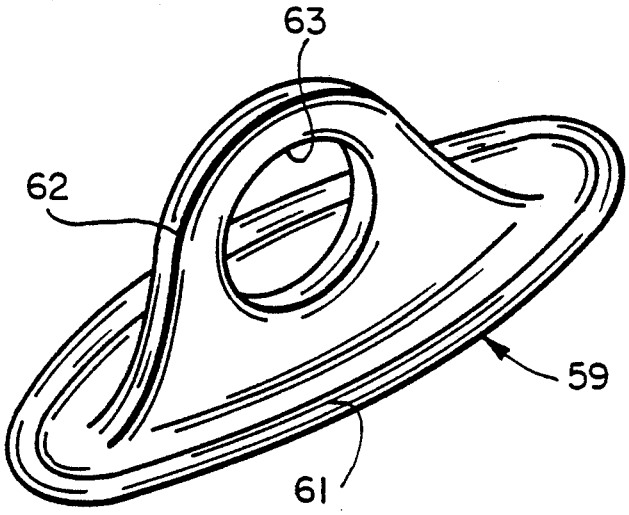
FIG. 10 is an isometric view of an embodiment of an eyelet for use in a waterbed mattress in accordance with the invention.

FIG. 10 illustrates an embodiment of an eyelet 59 which can be affixed to any wall of a waterbed mattress or bladder to provide an anchor point for a wave-reducing insert. This eyelet has a generally circular base 61 and a ring 62 which extends from the front side of the base, with an opening 63 in the ring for receiving a tether strap. The back side of the base is adapted to be affixed to the inside wall of the mattress or bladder by suitable means such as heat sealing or a suitable adhesive.

Eyelet 59 is preferably formed as a monolithic structure by a suitable process such as injection molding, and it fabricated of a material which can be affixed to a wall of the mattress. With a vinyl mattress, for example, the eyelet can be fabricated of polyvinylchloride. by a suitable process such as injection molding, and it fabricated of a material which can be affixed to a wall of the mattress. With a vinyl mattress, for example, the eyelet can be fabricated of polyvinylchloride.

FIG. 11 illustrates an embodiment in which the tether strap 66 comprises a U-shaped strap having a relatively short leg 67 which is connected to the upper eyelet 68 on a cornerpiece 69 and a relatively long leg 71 which is attached to a wave dampening insert 72. A cross piece 73 is formed at the distal end of the shorter leg, and a ring 74 is formed at the distal end of the longer leg. The strap, including the cross piece and the ring, is formed as an integral structure of a material such as a blend of polyethylene and EVA (ethylvinylacetate) which is somewhat pliant yet tends to return to the shape in which it is formed.

The longer leg of strap 66 is attached to insert by a rivet 76 which passes through ring 74, and the shorter leg of the strap is connected to the cornerpiece eyelet by bending cross piece 73 into alignment with the end portion of the longer leg, passing the end portion and the cross piece through the opening in the eyelet, then releasing the cross piece so that it returns to its original position and blocks withdrawal of the strap from the eyelet. Being somewhat flexible and longer than the distance between the eyelet and the rivet, the U-shaped strap can straighten out to permit some limited movement of the insert without being pulled taut.

In mattresses where the tether straps are relaxed and free of tension during normal use, an eyelet for anchoring the tether straps can be made by forming a strip of material such as vinyl into a loop and heat sealing it to a wall of the mattress. With the straps relaxed, there is no stress or pull on the heat sealed area to cause a failure or leakage at this point.

The invention has a number of important features and advantages. The wave controlling insert is held securely in place without any connection to the film material which forms the walls of the bag or bladder. With the insert tethered in this manner, the mattress can be drained, moved and reinstalled without any shifting of the insert within the mattress. Even a fiber mat will remain in place and will be smooth and ready to use when the mattress is refilled. In addition, the straps can function as part of the wave reducing structure, e.g. by maintaining a relatively light mat or sheet in tension.

It is apparent from the foregoing that a new and improved waterbed mattress and corner structure have been provided. While only certain presently preferred embodiments have been described in detail, as will be apparent to those familiar with the art, certain changes and modifications can be made without departing from the scope of the invention as defined by the following claims.

I claim:

1. In a waterbed mattress: walls of film material defining a chamber for holding water, a cornerpiece which is substantially thicker than the film material joined to the film material and forming a corner of the mattress, an insert disposed in the chamber for reducing wave action in the water, and a thether connected between the insert and the cornerpiece to retain the insert in a predetermined position in the chamber.

2. The waterbed mattress of claim 1 wherein the cornerpiece has an eyelet on the inner side thereof through which the tether passes.

3. The waterbed mattress of claim 2 wherein the cornerpiece and the eyelet are formed as a unitary structure by injection molding.

4. The waterbed mattress of claim 2 wherein the cornerpiece has a second eyelet spaced vertically from the first named eyelet.

5. The waterbed mattress of claim 1 wherein the tether comprises a flexible strap.

6. The waterbed mattress of claim 1 wherein the cornerpiece includes an eyelet, and the tether includes a strap having a retainer at one end thereof which can pass through the eyelet relatively freely in a forward direction but will not pass through the eyelet in a reverse direction.

7. The waterbed mattress of claim 1 wherein the tether maintains the insert in tension.

8. In a cornerpiece for a waterbed mattress having walls defining a chamber for holding water and an insert disposed in the chamber for reducing wave action in the water: a base plate substantially thicker than the walls of the mattress having front and rear sides and a peripheral sealing area for attachment to the walls, and means on the rear side of the base plate for receiving a tether for holding the insert in a predetermined position in the chamber.

9. The cornerpiece of claim 8 wherein the means for receiving the tether comprises an eyelet which projects from the rear side of the base plate.

10. The cornerpiece of claim 9 wherein the base plate and the eyelet are formed as an integral structure.

11. The cornerpiece of claim 10 wherein the base plate and the eyelet are formed by an injection molding process.

12. The cornerpiece of claim 8 wherein the cornerpiece has a second eyelet spaced vertically from the first named eyelet.

13. In a method of manufacturing a waterbed mattress, the steps of: forming a chamber of a flexible film material for holding water, positioning an insert in the chamber for controlling wave action in the water, attaching a cornerpiece to the film material to form a corner of the mattress, and tethering the insert to the cornerpiece to retain the insert in a predetermined position in the chamber.

14. The method of claim 13 wherein the cornerpiece is formed with an eyelet, and a tether is passed through the eyelet to tether the insert to the cornerpiece.

15. The method of claim 14 wherein the cornerpiece and the eyelet are formed as a unitary structure by injection molding.

16. The method of claim 13 wherein insert is tethered to the cornerpiece with a flexible strap.

17. The method of claim 13 wherein the insert is tethered in a manner which maintains the insert in a taut condition.

18. In a waterbed mattress: a bladder fabricated at least in part of a flexible material defining a chamber for holding water, a horizontal insert disposed in the chamber and extending a substantial portion of the length and the width of the chamber for reducing wave action in the water, a base plate affixed to the bladder, means affixed to the base plate forming an anchor point within the chamber, and a tether extending between the insert and the anchor point for retaining the insert in a predetermined position in the chamber.

19. The waterbed mattress of claim 18 wherein the base plate is affixed to a corner portion of the bladder and forms a corner of the bladder.

20. The waterbed mattress of claim 18 wherein the tether comprises a strap which is normally in a relaxed condition when the insert is in the predetermined position.

21. In a method of manufacturing a waterbed mattress, the steps of: forming a chamber for holding water within a bladder of flexible material, positioning a horizontally extending insert in the chamber so that the insert extends for a substantial portion of the length and the width of the chamber for controlling wave action in the water, attaching a base plate to the bladder to form an anchor point within the chamber, and tethering the insert to the anchor point to retain the insert in a predetermined position in the chamber.

22. The method of claim 21 wherein an eyelet is affixed to the base plate, and the insert is tethered to the anchor point by passing a flexible tether through the eyelet.

23. In a waterbed mattress: a bladder of tubular shape fabricated at least in part of a flexible material defining a chamber for holding water, an insert disposed in the chamber for reducing wave action in the water, means affixed to the tubular bladder toward one end thereof forming an eyelet with an opening defining an anchor point within the chamber, and a tether extending between the insert and the anchor point and passing through the opening in the eyelet for retaining the insert in a predetermined position in the chamber.

* * * * *